US005276454A

United States Patent [19]

Gonzalez et al.

[11] Patent Number: 5,276,454

[45] Date of Patent: Jan. 4, 1994

[54] CONTROL AND ANTENNA MOUNT ASSEMBLY

[75] Inventors: Armando J. Gonzalez, Miami; Steven J. Finch, Sunrise; Rudy Yorio, Boca Raton, all of Fla.

[73] Assignee: Motorola, Inc., Schaumburg, Ill.

[21] Appl. No.: 951,026

[22] Filed: Sep. 24, 1992

Related U.S. Application Data

[63] Continuation of Ser. No. 716,173, Jun. 17, 1991, abandoned.

[51] Int. Cl.[5] ..... H01Q 1/24

[52] U.S. Cl. ..... 343/702; 343/906; 343/720

[58] Field of Search ..... 343/702, 904, 715, 906, 343/900, 903, 888, 720; 439/916; 174/74; H01Q 1/24

[56] References Cited

U.S. PATENT DOCUMENTS

| | | | |
|---|---|---|---|
| 1,666,480 | 4/1928 | Zillger | 343/702 |
| 1,854,566 | 4/1932 | Spiro | 343/702 |
| 2,810,909 | 10/1957 | Finkel | 343/702 |
| 2,902,688 | 9/1959 | Foster | 343/702 |
| 3,281,847 | 10/1966 | Herrero | 343/702 |
| 3,573,628 | 4/1971 | Cramer, Jr. et al. | 343/702 |
| 3,946,317 | 3/1976 | Ishimaru et al. | 343/702 |

FOREIGN PATENT DOCUMENTS

| | | | |
|---|---|---|---|
| 0178603 | 10/1983 | Japan | 343/702 |

*Primary Examiner*—Donald Hajec
*Assistant Examiner*—Hoanganh Le
*Attorney, Agent, or Firm*—Pedro P. Hernandez

[57] ABSTRACT

A control and antenna mount assembly (100) includes an antenna mount portion (130) having a top portion (132) for mating to an antenna (142). Assembly (100) also includes an insert member (122), control knob (110) having selector contact (118) and a retainer ring (120) all connected to antenna mount (130), together forming a rotary switch, concentric to antenna mount (130).

22 Claims, 4 Drawing Sheets

FIG.2A
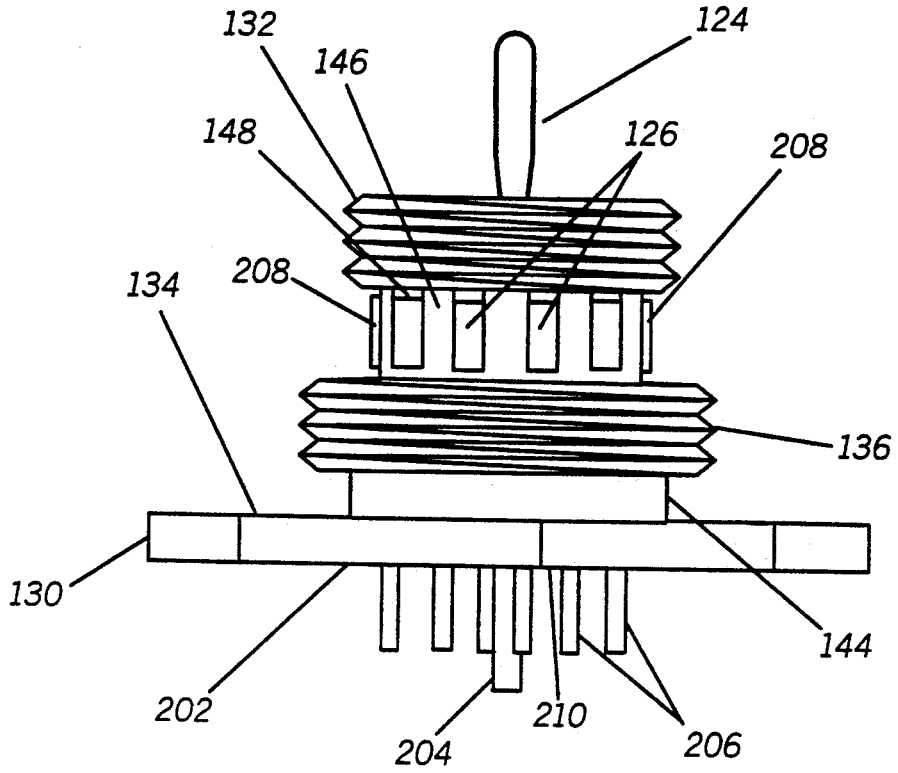
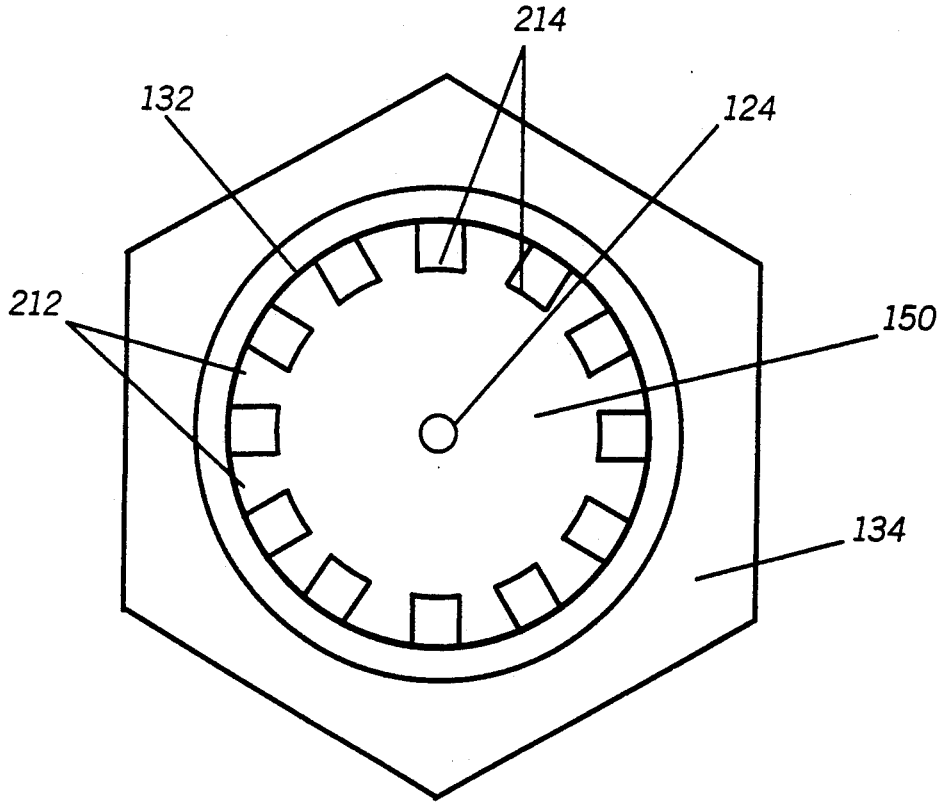
FIG.2B

CONTROL AND ANTENNA MOUNT ASSEMBLY

This is a continuation of application Ser. No. 07/716,173, filed Jun. 17, 1991, and now abandoned.

TECHNICAL FIELD

This invention relates to antenna mount assemblies, and more specifically to a control and antenna mount assembly for use with a communication device having an antenna.

BACKGROUND

Technological advances in the field of communication have allowed communication devices such as portable radios to become smaller and smaller in size. This however has decreased the amount of useable housing surface area ("real estate") that can be used to mount user controls (e.g. switches, volume controls, keypads, etc.), as well as the communication device's antenna. Correspondingly, as communication devices have become more sophisticated over time, there has been an increased need to increase the number of controls in order to handle the increased number of features found in modern communication devices. These opposite competing forces have created a need for new ways of minimizing the amount of area taken up by user controls. A need therefore exists in the art for more real estate efficient uses of the smaller housing areas found on modern communication products.

SUMMARY OF THE INVENTION

By combining a user control with an antenna mount into a single assembly, real estate usage can be minimized.

The control and antenna assembly comprises an antenna mount portion and a control that is coupled to the antenna mount portion.

In one aspect of the invention, the control is a rotary switch concentric with the antenna mount portion.

In still another aspect of the present invention, a communication device having an antenna comprises; a housing, and a control and antenna mount assembly that includes an antenna mount portion, and a control that is coupled to the antenna mount portion.

BRIEF DESCRIPTION OF THE DRAWINGS

FIG. 2A is a side view of the antenna mount portion with insert member in place, in accordance with the present invention.

FIG. 2B is a top view of the antenna mount with insert member in place.

DETAILED DESCRIPTION OF THE PREFERRED EMBODIMENT

Figure 1:
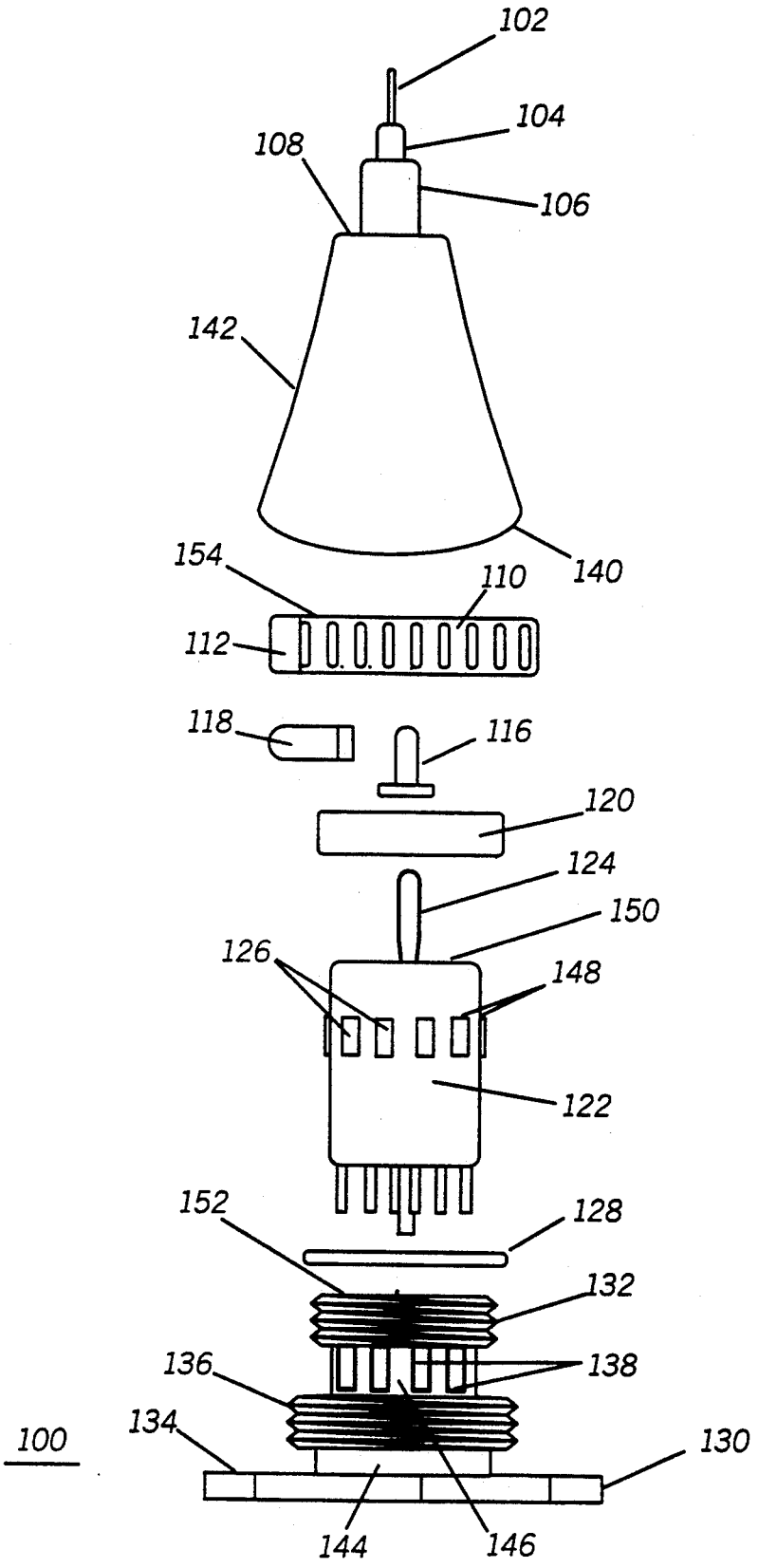
FIG. 1 is an exploded view of a control and antenna mount assembly in accordance with the present invention.

In FIG. 1, an exploded view of a portion of an antenna 142 and a control and antenna mount assembly 100 in accordance with the present invention is shown. Antenna 142 has an outer flexible surface 108 and a center antenna conductor 102. Antenna conductor 102 is insulated by insulating sleeve 104 which surrounds the antenna conductor 102. Insulating sleeve 104 is surrounded by shield 106, that is normally a wire mesh or braid similar to those found on conventional coaxial cables. Antenna 142, has a base portion 140 that includes terminals that are electrically connected to antenna conductor 102 and shield 106 (shown in FIG. 3). Preferably, base portion 140 has a threaded metal portion (shown in FIG. 3) that is electrically connected to shield 106 and has an electrical terminal socket (shown in FIG. 3) that is insulated from the threaded portion and is electrically connected to antenna conductor 102. Although in the preferred embodiment a coaxial antenna has been shown (antenna 142) other types of antennas, including those using a single conductor can be used.

Control and antenna mount assembly 100 includes all that is shown in FIG. 1 except for antenna 142. In the preferred embodiment, assembly 100 includes a rotary switch as the control which is part of the assembly. Assembly 100 includes an antenna mount portion 130 having bottom threaded portion 136 and top threaded portion 132. Between the top and bottom threaded portions 132 and 136 respectively, antenna mount 130 includes an outer wall 146 having selective apertures 138. Antenna mount 130 also includes a metal mounting surface 134. Between metal mounting surface 134 and bottom threaded portion 136 lies a seal surface wall 144. A seal such as a standard rubber O-ring 128, or another type of conventional seal, is placed over antenna mount 130 and rests on mounting surface 134. Seal 128 will surround seal surface wall 144 which is part of the outer wall of antenna mount 130. Antenna mount 130 is preferably made from a single piece of cast or milled metal.

Insert member 122, which is part of the assembly's switch portion, is preferably an insert molded piece of plastic having a series of metal inserts with electrically conductive terminals 126 that are placed on the outer wall of protruding members 148. Electrically conductive terminals 126 are selectively placed all around the outer surface of insert member 122. A single continuous electrical conductor runs through the center of insert member 122 and has a first terminal 124 protruding from the top surface 150 of insert member 122. Insert member 122 is placed inside of cavity area 152 which is part of antenna mount 130. The electrically conductive terminals 126 of insert member 122 being accommodated by the selective apertures 138, thereby allowing for the electrically conductive terminals 126 to slightly protrude through apertures 138.

Metal spanner nut 120 which has an inner threaded portion is threaded into bottom thread portion 136 of antenna mount 130. Spanner nut 120 holds metal mounting bushing 134 against the inner wall of a housing member (not shown). Metal pin 116 is then placed on top of the top terminal 124 of the electrical conductor which runs the length of center bushing 122. Metal pin 116 can be either soldered or pressed onto top terminal 124. Metal pin 116 plugs into the bottom socket of antenna 142 (shown in FIG. 3) and makes electrical contact with center conductor 102, when antenna 142 is threaded into top threaded portion 132.

Assembly 100 also includes a control knob 110 that is part of the control (switch portion), preferably made from molded plastic and fitting between the top and bottom threaded portions 132 and 136 respectively. Control knob 110, includes a selector contact 118, that fits in control knob indicator area 112 and is preferably made from a metal such as beryllium copper, that is formed to give contact 118 a spring action. A second contact, that would not be electrically connected, could be added to the opposite side of the control knob 110 in order to balance the pressure placed by contact 118 and help retain knob 110. Control knob 110 can also have a conventional snap feature (not shown) such as the addition of a channel around the inside wall 154 of knob 110, that would mate with snaps (not shown) located on the outer wall 146 of antenna mount 130 allowing for the further retention of control knob 110 once it is placed.

Selector contact 118 acts as the position locator for the rotary switch, formed by the combination of insert member 122 and control knob 110. A portion of selector contact 118 is pressure fitted against spanner nut 120 that in turn makes contact with the control top of the communication device housing (not shown) which is preferably at ground potential. As control knob 110 is rotated, contact 118 selectively engages one of the plurality of electrically conductive terminals 126 that are accessible via apertures 138 and in effect grounds the given terminal 126.

In FIG. 2A a perspective view of antenna mount 130, with insert member 122 in place, is shown. Electrically conductive surfaces 126 are shown protruding from apertures 138. Side walls 208, of protruding members 148, are non-conductive in order for the electrically conductive surfaces 126 not to form an electrical contact with the outer wall 146 of antenna mount 130 and thereby "short" the conductive surfaces 126. Also shown in FIG. 2A is bottom aperture 202 which allows for interconnection pins 206, that are electrically connected to corresponding electrical surfaces 126 on a one to one basis to protrude from the bottom of antenna mount 130. Also protruding from the bottom surface 210 of insert member 122 is second terminal 204 that is part of the electrical conductor which runs through the center of insert member 130. Also shown in FIG. 2A, is seal surface 144, found between bottom threaded portion 136 and mounting surface 134. As can be seen in FIG. 2A, the top portion of the antenna mount 130 with insert member 122 in place forms a coaxial connector for connecting with antenna 142. Top threaded portion 132 forms the ground conductor for the coaxial connector, while first terminal 124 forms the center conductor of the coaxial connector.

In FIG. 2B a top view of antenna mount 130 with insert member 122 inside of cavity area 216 is shown. The inner wall 214 of top threaded portion 132 includes a plurality of grooves 212 that allow protruding members 148 to slide through thereby allowing insert member 122 to fit inside of hollow cavity 216.

Figure 3:
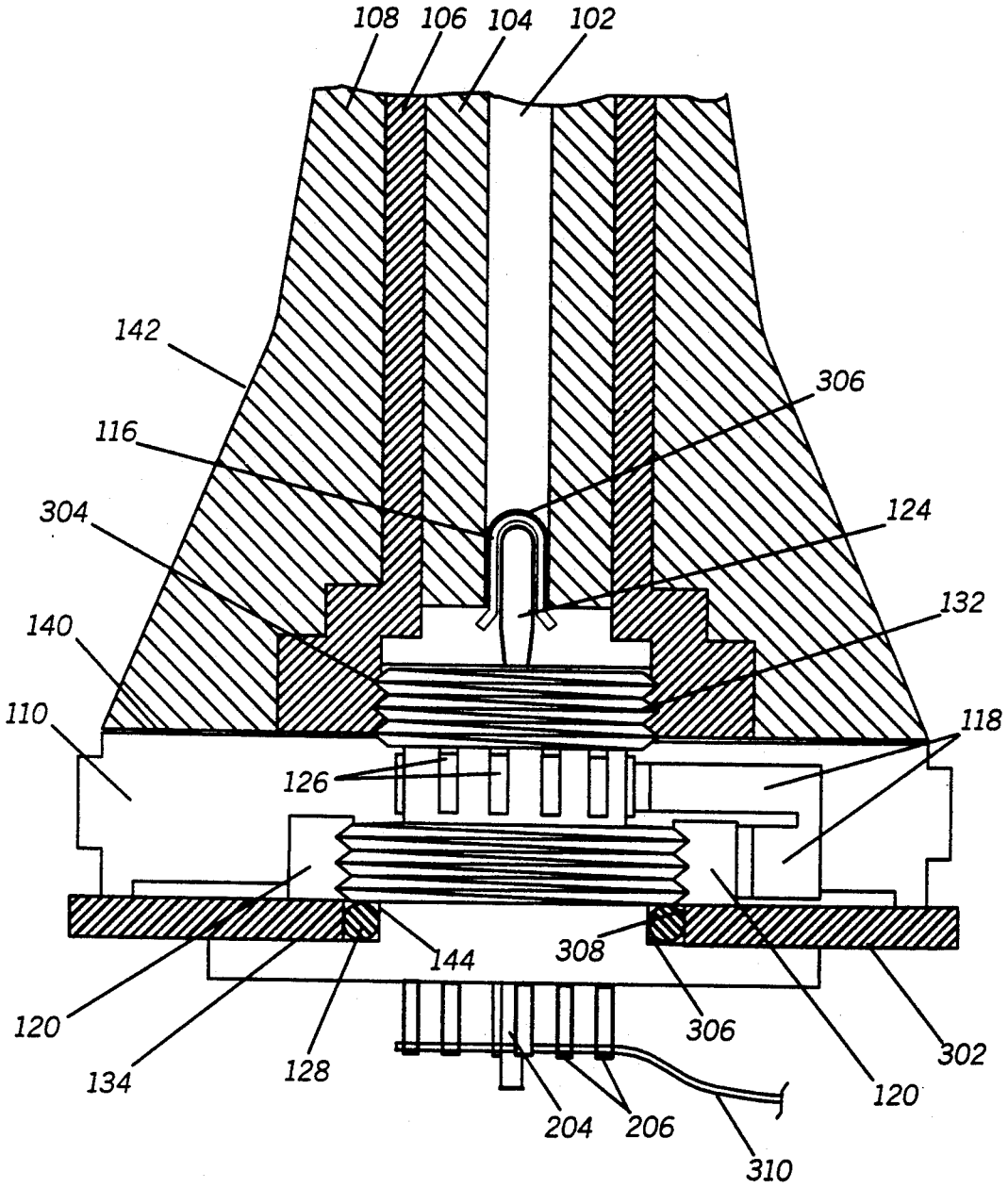
FIG. 3 is a partial cross-sectional view of the control and antenna mount assembly connected to an antenna in accordance with the present invention.

In FIG. 3 a cross-sectional view of the control and antenna mount assembly 100 and antenna 142 are shown mounted onto a housing member 302. In the preferred embodiment housing member 302 is the "control top" (surface area where controls are mounted) of a communication device such as a radio. Housing member 302 is preferably made from an electrically conductive material such as formed sheet metal. Housing member 302 should preferably be connected to the ground terminal of the communication device, forming a chassis ground.

Housing member 302 includes aperture 306 that allows for the insertion of antenna mount 130 through housing member 302. Antenna mount 130 is placed through aperture 306 and is retained by metal mounting surface 134 and spanner nut 120, which is threaded into bottom threaded portion 136. Prior to screwing in spanner nut 120, a seal such as O-ring 128 is placed in position between the housing member aperture wall 308 and seal surface 144. The resilient O-ring 128 provides a seal against environmental conditions such as dust and water spray from getting inside the communication device housing via aperture 306 and damaging the device.

After spanner nut 120 is threaded into bottom threaded portion 136, control knob 110 is placed into position with selector contact 118 placed inside of control knob indicator portion 112. The bottom portion of selector contact 118 forms a pressure contact with spanner nut 120 once control knob 110 is in place. Selector contact 118 is placed at ground potential since spanner nut 120 is making electrical contact with chassis 302 which is also at ground potential (chassis ground). As the top portion of selector contact 118 touches the individual electrically conductive surfaces 126, one at a time, (as control knob 110 is rotated) the individual conductive surfaces 126 are sent to ground potential. The interconnection pin 206 that corresponds to the grounded conductive surface 126 also goes to ground potential.

All of the individual interconnection pins 206 as well as the second terminal 204 that provides the RF (Radio frequency) signal to antenna 142 are preferably connected to the rest of the radio components (not shown) via a flexible circuit 310 ("flex") that connects all of the interconnection contacts 206 and the second terminal 204. Flexible circuit 310 preferably includes a micro strip to carry the RF signal from second terminal 204 to the appropriate point in the communication device. The interconnection contacts 206 are preferably electrically connected to the input/output terminals of a conventional microcontroller, or microprocessor that can determine which contact 206 has been grounded. Although the preferred embodiment grounds the selected conductive surfaces 126, there is no reason why a voltage potential greater than ground potential could not be applied.

Since the center conductor (having terminals 124 and 204) that goes through insert member 122 is carrying a RF signal, antenna mount apertures 138 should be kept as small as possible to keep a grounded ring around the center conductor along the height of antenna mount 130. Preferably insert member 122 has a grounded sleeve (not shown) along the perimeter of the center conductor along the entire height of antenna mount 130 (molded into the insert member 122, similar to shield 106), thereby preserving the impedance of the coaxial connection to approximately 50 ohms (those skilled in the art will appreciate the different impedance values can also be used).

Also shown in FIG. 3 is the threaded portion 304 of antenna 142 which threads to the threaded portion 132 of antenna mount 130. Antenna 142 also includes a receptacle 306 for receiving metal pin 116, when antenna 142 is threaded into antenna mount 130.

Figure 4:
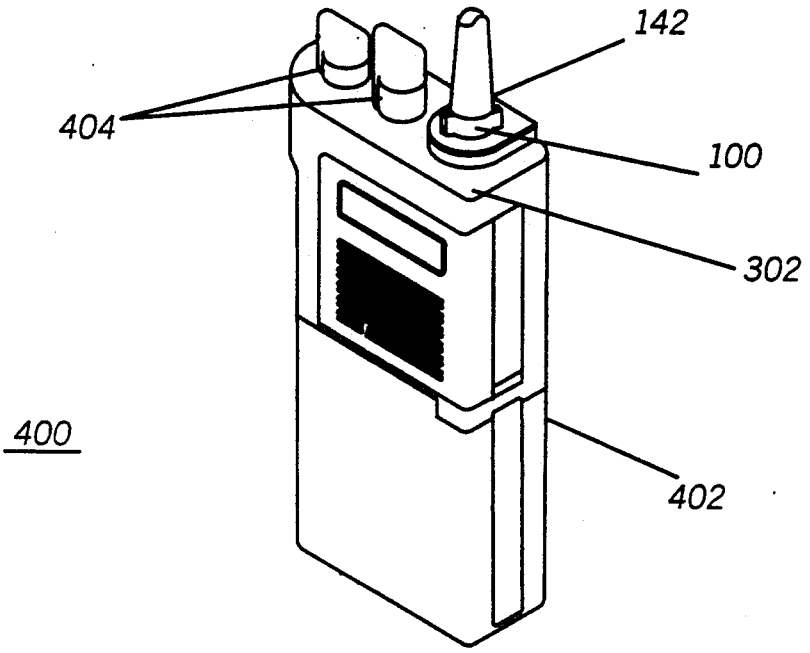
FIG. 4 is a drawing of a communication device having a control and antenna mount assembly in accordance with the present invention.

In FIG. 4 a drawing of a communication device 400 such as a radio having a switch assembly 100 for mounting an antenna 142 is shown. Communication device 400 can be any type of communication device, such as a radio, portable television set, etc. Assembly 100 is shown mounted to control top surface 302 which is also shown with other controls 404. Although assembly 100 has been shown in the preferred embodiment as a switch and antenna mount assembly, any other type of control (switch, potentiometer, electrical control, etc.)

can be built into assembly 100, such as volume controls, squelch controls, etc. Instead of placing a switch inside of assembly 100, a variable potentiometer (for use as a volume control) or other similar device can be designed into assembly 100 by those skilled in the art.

As can be seen from the previous description, by utilizing the area normally used to mount an antenna 142, to also mount a switch or other control, a great space saving can be achieved. Another benefit of mounting a switch at the base of an antenna 142 is that ergonomically a user can feel for the antenna 142 and without looking, easily find the switch by sliding his hand down the antenna mast which is an easily accessible target (especial benefit for night time operation). Also, by mounting the switch underneath the antenna 142, the antenna 142 protects the switch portion from the shock of dropping the communication device 400. Another major benefit of the present invention is that a substantial portion (e.g. greater than 50%) of the control and antenna mount assembly 100 is physically located outside the radio housing 402. By keeping the major portion of the control (in the preferred embodiment, a rotary switch) outside of the communication device housing 402 and away from the internal electronics, less of the valuable internal space of radio 400 is used by the control (e.g. rotary switch). Standard communication device controls use up a very large area of the overall internal area found inside of communication devices such as radio 400. By using the present invention a major internal space savings can be achieved inside of radio 400, thereby allowing the space to be utilized for more valuable uses (e.g. more sophisticated electronics, etc.).

As been shown, by creating a control and antenna mount assembly 100 that includes an antenna mount 130 as part of the assembly, a major space and cost savings can be achieved. The present invention is especially useful in new designs that tend to be smaller in size and that require the benefits of the present invention. For small portable devices the present invention also adds an ergonomically benefit in allowing for easy access to the control.

What is claimed is:

1. A control and antenna mount assembly for use with a communication device, comprising:

an antenna mount having a top portion forming an antenna connector for receiving an antenna, the antenna mount having an outer wall including a plurality of electrical contacts, and a bottom portion for mating to the communication device; and a selector contact mechanically coupled to the antenna mount forming an electrical control which selects one of the electrical contacts found in the antenna mount.

2. The control and antenna mount assembly of claim 1, wherein the electrical control comprises a switch.

3. The control and antenna mount assembly of claim 1, wherein the electrical control comprises a rotary switch concentric to the antenna mount.

4. The the control and antenna mount of claim 1, wherein a substantial portion of the control and antenna mount assembly is physically located outside the communication device.

5. A control and antenna mount assembly, comprising:

an antenna mount having a top portion forming an antenna connector for receiving an antenna, the antenna mount further including a plurality of electrical contacts;

a selector contact mechanically coupled to the antenna mount for selecting one of the electrical contacts found in the antenna mount; and an insert member having top and bottom opposed surfaces and an electrical conductor that has a first terminal at the top surface and a second terminal at the bottom surface and the insert member rests within the antenna mount.

6. The control and antenna mount assembly of claim 5, wherein the antenna mount top portion and the top surface of the insert member form a coaxial connector.

7. The control and antenna mount assembly of claim 5, wherein the antenna mount portion includes a plurality of apertures and the insert member includes a plurality of electrically conductive terminals that show through the apertures when the insert member is resting inside of the antenna mount portion.

8. The control and antenna mount assembly of claim 7, wherein the electrically conductive terminals are electrically coupled to interconnection pins found on the bottom surface of the insert member.

9. The control and antenna mount assembly of claim 8, wherein the control further includes a rotatable control knob coupled to the selector contact for electrically selecting one of the electrically conductive terminals found on the insert member.

10. A control and antenna mount assembly for use with a communication device having an antenna, comprising:

an antenna mount having a top portion forming an antenna connector for mating to the antenna and a base portion for mating to the communication device, the antenna mount including an outer wall having a plurality of apertures and an inner cavity; and an insert member having top and bottom opposed surfaces and an electrical conductor that has a first terminal at the top surface and a second terminal at the bottom surface, the insert member including a plurality of electrically conductive terminals that show through the apertures of the antenna mount when the insert member is placed inside the inner cavity of the antenna mount portion.

11. The control and antenna mount assembly of claim 10, wherein the electrically conductive terminals are electrically coupled to interconnection pins found on the bottom surface of the insert member.

12. The control and antenna mount assembly of claim 11, wherein the control further includes a rotatable control knob having a selector contact that electrically selects one of the electrically conductive terminals found on the insert member.

13. The control and antenna mount assembly of claim 12, wherein the first terminal at the top surface of the insert member provides an antenna contact when the communication device antenna is mated to the top of the antenna mount portion.

14. A communication device having a removable antenna, the communication device comprising:

a communication device housing; and a control and antenna mount assembly coupled to the communication device housing including:

an antenna mount having a top portion forming an antenna connector for receiving the removable antenna, the antenna mount further including a bottom portion for mating to the communication device housing and an outer wall having a plurality of electrical contacts; and a selector contact mechanically coupled to the antenna mount forming an electrical control for selecting one of the electrical contacts found on the outer wall.

15. The communication device of claim 14, wherein the electrical control comprises a rotary switch concentric with the antenna mount.

16. The communication device of claim 15, wherein the electrical control includes a control knob about the outer wall of the antenna mount.

17. The communication device of claim 14, wherein the top portion of the antenna mount comprises a coaxial connector.

18. The communication device of claim 14, wherein a substantial portion of the control and antenna mount assembly is physically located outside the communication device housing.

19. A communication device as defined in claim 14, wherein the selection of one of the electrical contacts by the selector contact causes a communication device parameter to be modified.

20. An antenna mount assembly for use with a communication device having a housing and utilizing an antenna, the antenna mount assembly comprising:

an antenna mount having an outer wall and a top portion comprising an antenna connector for mating to the antenna, the antenna mount also having a bottom portion for mechanically coupling to the communication device housing, the antenna mount including a plurality of electrical contacts; and a movable selector contact mechanically coupled to the antenna mount for selecting one of the electrical contacts found in the antenna mount upon the movable selector contact being moved about the outer wall of the antenna mount.

21. The antenna mount assembly of claim 20, wherein the movable selector contact and antenna mount form an electrical switch.

22. An antenna mount assembly for use with a communication device, comprising:

an antenna mount having a top portion forming an antenna connector for receiving an antenna, the antenna mount having a bottom portion for mating to the communication device and a wall located between the top and bottom portions of the antenna mount; and a switch means coupled to and substantially around the periphery of the antenna mount wall for providing an electrical switching function.

* * * * *